US007238259B2

(12) United States Patent
O'Connor et al.

(10) Patent No.: US 7,238,259 B2
(45) Date of Patent: Jul. 3, 2007

(54) METHODS OF SEAMING

(75) Inventors: Joseph G. O'Connor, Hopedale, MA (US); Victor P. Laskorski, Attleborough, MA (US)

(73) Assignee: Albany International Corp., Albany, NY (US)

( * ) Notice: Subject to any disclaimer, the term of this patent is extended or adjusted under 35 U.S.C. 154(b) by 464 days.

(21) Appl. No.: 10/732,117

(22) Filed: Dec. 10, 2003

(65) Prior Publication Data

US 2005/0130531 A1 Jun. 16, 2005

(51) Int. Cl.
*D21F 1/10* (2006.01)
*D03D 3/04* (2006.01)

(52) U.S. Cl. ..... 162/358.2; 162/348; 162/902; 162/903; 162/904; 428/58; 139/383 AA; 24/31 B; 24/38

(58) Field of Classification Search ..... 162/348, 162/358.1, 358.2, 900–904; 139/383 A, 139/425 A, 383 AA; 428/57, 58; 245/10; 57/22, 202; 24/38, 31 B, 31 L
See application file for complete search history.

(56) References Cited

U.S. PATENT DOCUMENTS

| | | | | |
|---|---|---|---|---|
| 3,060,547 | A | 10/1962 | MacBean | |
| 3,238,594 | A | 3/1966 | Schuster | |
| 3,436,041 | A * | 4/1969 | Haller | 245/10 |
| 3,634,972 | A * | 1/1972 | Illman | 57/202 |
| 3,672,148 | A * | 6/1972 | Benson et al. | 57/2 |
| 3,904,458 | A * | 9/1975 | Wray | 156/85 |
| 3,947,619 | A * | 3/1976 | Wank | 428/57 |
| 4,083,090 | A | 4/1978 | Duvekot | |
| 4,428,992 | A * | 1/1984 | Street | 428/114 |
| 4,435,457 | A * | 3/1984 | Servo et al. | 428/58 |
| 4,469,142 | A * | 9/1984 | Harwood | 139/383 AA |
| 4,501,782 | A | 2/1985 | Weatherly et al. | |
| 5,360,656 | A * | 11/1994 | Rexfelt et al. | 428/193 |
| 5,480,604 | A | 1/1996 | Johnson et al. | |
| 5,670,230 | A | 9/1997 | Schlueter, Jr. et al. | |
| 5,707,496 | A | 1/1998 | Johnson et al. | |
| 5,713,399 | A * | 2/1998 | Collette et al. | 139/383 AA |
| 5,731,063 | A | 3/1998 | Schultz et al. | |
| 6,162,518 | A | 12/2000 | Korfer | |
| 6,440,881 | B1 | 8/2002 | Ercken | |

* cited by examiner

*Primary Examiner*—Eric Hug
(74) *Attorney, Agent, or Firm*—Frommer Lawrence & Haug LLP; Ronald R. Santucci

(57) ABSTRACT

A papermaker's fabric and a method of forming a papermaker's fabric, for installation in a papermaking machine. The papermaker's fabric having a plurality of cross-machine, a plurality of machine directional yarns, and a plurality of heat shrunk joints connecting ends of either the machine directional yarns or the cross machine directional yarns to form and continuous loop of fabric. The papermaker's fabric is formed by providing a fixture for securing a plurality of heat shrink tubing sections. Two or more corresponding yarns of the papermaker's fabric are inserted into each of the heat shrink tubing sections and heat is applied to the heat shrink tubing. Upon application of the heat the heat shrink tubing reduces its size to form a tight joint between two yarns inserted therein.

26 Claims, 7 Drawing Sheets

METHODS OF SEAMING

BACKGROUND OF THE INVENTION

1. Field of the Invention

The present invention relates to papermakers fabrics and in particular to fabrics which are seamed to provide a continuous belt when installed on papermaking equipment.

2. Description of the Prior Art

During the papermaking process, a cellulosic fibrous web is formed by depositing a fibrous slurry, that is, an aqueous dispersion of cellulose yarns, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic yarns in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

At one time, industrial fabrics used in papermaking were manufactured and supplied only in endless form. This is because a newly formed cellulosic fibrous web is extremely susceptible to marking in the press nip by any nonuniformity in the fabric or fabrics. An endless, seamless fabric, such as one produced by the process known as endless weaving, has a uniform structure in both its longitudinal (machine) and transverse (cross-machine) directions.

Contemporary papermaker's fabrics such as a press fabric are produced in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

However, a seam, such as a seam which may be used to close the fabric into endless form during installation on a paper machine, represents a discontinuity in the uniform structure of the fabric. The use of a seam, then, greatly increases the likelihood that the cellulosic fibrous web will be marked in the press nip. Therefore, it is less desirable to utilize a papermaker's fabric having such a seam.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce fabrics, and belts, to the dimensions required to fit particular positions in the paper machines of their customers. Needless to say, this requirement makes it difficult to streamline the manufacturing process, as each fabric must typically be made to order.

Because the use of seamed fabric is not always desireable, and because whether flat woven and formed endless, or woven endless, there are a large number of varieties papermaker's fabrics in an even larger array of sizes an alternative to the known methods of forming a papermaker's fabric was desired.

In response to a need to produce fabrics in a variety of lengths and widths more quickly and efficiently, press fabrics have been produced in recent years using a spiral technique disclosed in commonly assigned U.S. Pat. No. 5,360,656 to Rexfelt et al., the disclosure of which is incorporated herein by reference.

FIG. 1 shows a press fabric according to U.S. Pat. No. 5,360,656 comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding as shown in FIG. 4. Alternatively, adjacent longitudinal end portions of adjoining spiral turns may be arranged overlappingly, so long as the ends have a reduced thickness, so as not to give rise to an increased thickness in the area of the overlap, as shown in FIG. 5. Further, the spacing between lengthwise yarns may be increased at the ends of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction, as shown in FIG. 2. The angle between the machine direction of the woven base fabric and the helically continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric, as shown in FIG. 1. It will be recognized that endless base fabrics in a variety of lengths and widths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a press fabric comprising a base fabric having two layers, each composed of a spirally wound strip of woven fabric, as shown in FIG. 3. Both layers take the form of an endless loop, one being inside the endless loop formed by the other. Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral.

In such a two-layer, laminated base fabric, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer.

In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

As a consequence, the base fabrics shown in U.S. Pat. No. 5,360,656 have no defined machine- or cross-machine-direction yarns. Instead, the yarn systems lie in directions at oblique angles to the machine and cross-machine directions. A press fabric having such a base fabric may be referred to as a multiaxial press fabric. Whereas the standard press fabrics of the prior art have three axes: one in the machine direction (MD), one in the cross-machine direction (CD), and one in the z-direction, which is through the thickness of the fabric, a multiaxial press fabric has not only these three axes, but also has at least two more axes defined by the directions of the yarn systems in its spirally wound layer or layers. Moreover, there are multiple flow paths in the z-direction of a multiaxial press fabric. As a consequence, a multiaxial press fabric has at least five axes. Because of its multiaxial structure, a multiaxial press fabric having more than one layer exhibits superior resistance to nesting and/or to collapse in response to compression in a press nip during the papermaking process as compared to one having base fabric layers whose yarn systems are parallel to one another.

It has been further determined that the method as outlined in U.S. Pat. No. 5,360,656 can be used for any papermaker's fabric which is desired to be in endless form.

The methods of joining the spirally wound relatively narrow woven fabric strips described in U.S. Pat. No. 5,360,656, include sewing (for instance with water-soluble thread), melting, and welding (for instance ultrasonic welding), of non-woven material, or of non-woven material with melting fibers. The edge joint can also be obtained by providing the fabric strip of yarn material along its two longitudinal edges with seam loops of known type, which can be joined by means of one or more seam threads. However, each of these techniques has attendant advantages and disadvantages known to those of skill in the art.

Accordingly, it is desirable, therefore, to manufacture an industrial textile fabric that has a simple and efficient means for forming a seam and which displays adequate strength, and smoothness characteristics and overcomes the limitations of the currently available methods.

SUMMARY OF THE INVENTION

It is an object of the present invention to provide a papermaker's fabric used in a paper making machine that exhibits improved seam characteristics.

It is a further object of the invention to provide a fabric seamed in a manner that optimizes the benefits realized by spiral winding, while minimizing the effects of the seam on the paper.

It is a further object of the invention to provide an apparatus for joining yarns of a papermaker's fabric using heat shrinking tubing.

It is a further object of the present invention to provide a seaming method for a fabric used in a papermaking machine that achieves the aforementioned objectives.

The present invention is a fabric used in a papermaking machine that has reduced effects from the seaming process which last over the entire fabric lifetime.

A first embodiment of the present invention is an endless papermaker's fabric for installation in a papermaking machine having a plurality of fabric strips formed of MD and CD yarns, and a plurality of heat shrunk joints connecting at least a percentage of the CD yarns to form a continuous loop of fabric, where the heat shrunk joints form an MD seam in said endless papermaker's fabric.

A further embodiment the present invention is directed to a papermaker's fabric for installation in a papermaking machine. The papermaker's fabric having a plurality of cross-machine directional yarns. The papermaker's fabric further having a plurality of machine directional yarns, and a plurality of heat shrunk joints connecting ends of the machine directional yarns to form a continuous loop of fabric.

Yet another embodiment of the present invention is a method of forming a papermaker's fabric. The papermaker's fabric is formed by providing a fixture for securing a plurality of heat shrink tubing sections. The two corresponding yarns of the papermaker's fabric are inserted into each of the heat shrink tubing sections. Heat is applied to the heat shrink tubing which reduces its size to form a tight joint between the two yarns inserted therein.

Another embodiment of the present invention is an apparatus for forming a seam in an on machine seamable papermaker's fabric. The apparatus includes a grooved fixture for supporting a plurality of heat shrink tubing sections. The apparatus further includes a heating means for applying heat to the heat shrink tubing, where upon application of the heat the heat shrink tubing reduces its size to form a tight joint between the two yarns inserted therein.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated.

BRIEF DESCRIPTION OF THE DRAWINGS

Thus by the present invention, its objects and advantages will be realized, the description of which should be taken in conjunction with the drawings wherein.

DETAILED DESCRIPTION OF THE INVENTION

The present invention is directed to novel methods of seaming, which provide adequate seam strength with little or no effect on the structure at the seam point compared to the body of fabric in paper machine clothing. The examples below describe methods for joining yarn ends by using heat shrinkable tubing. Similar components are numbered the same throughout the figures.

Figure 1:
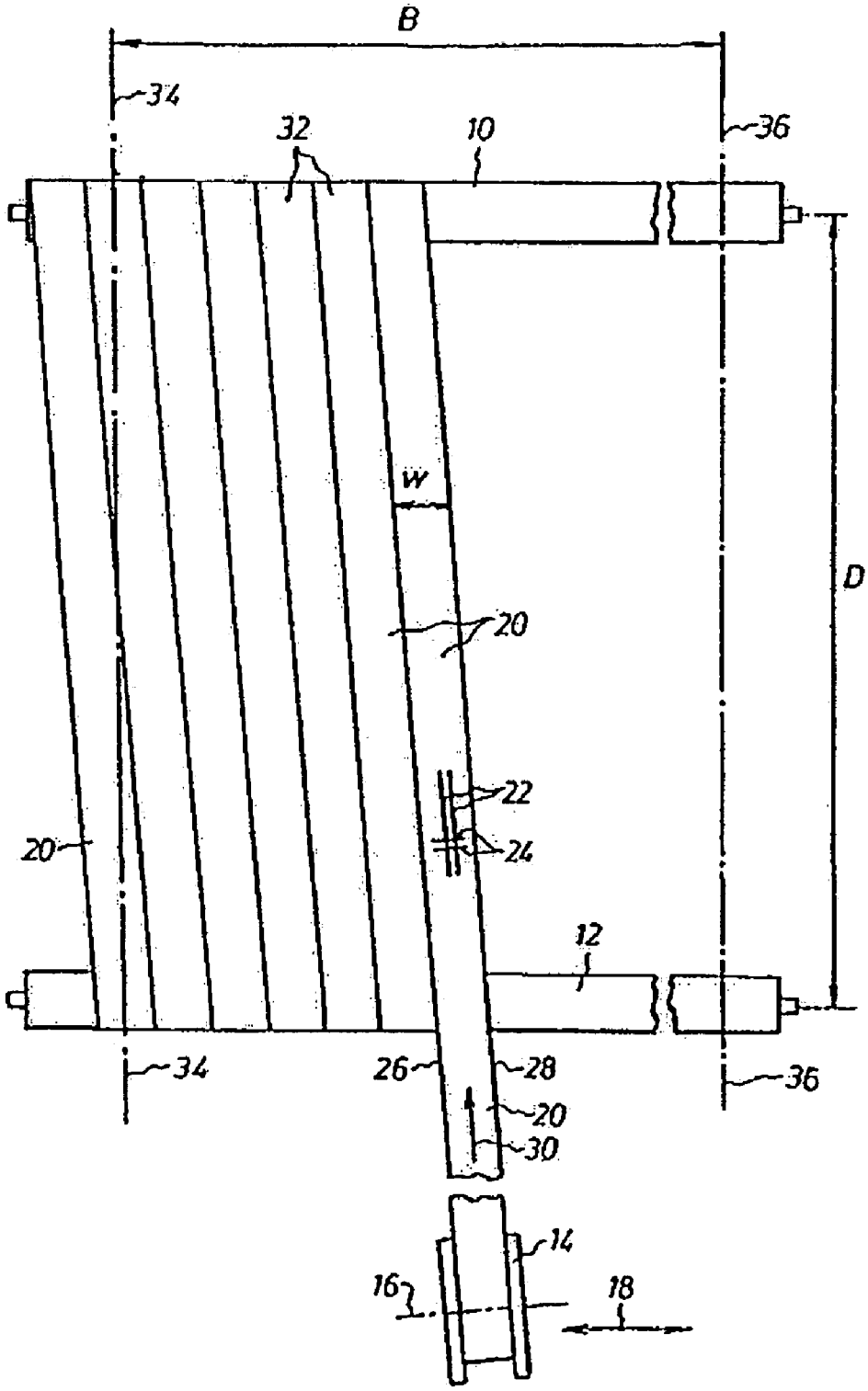
FIG. 1 (PRIOR ART)
FIG. 1 is a plan view of a spiral wound papermaker's fabric and device for forming such a fabric.
Figure 2:
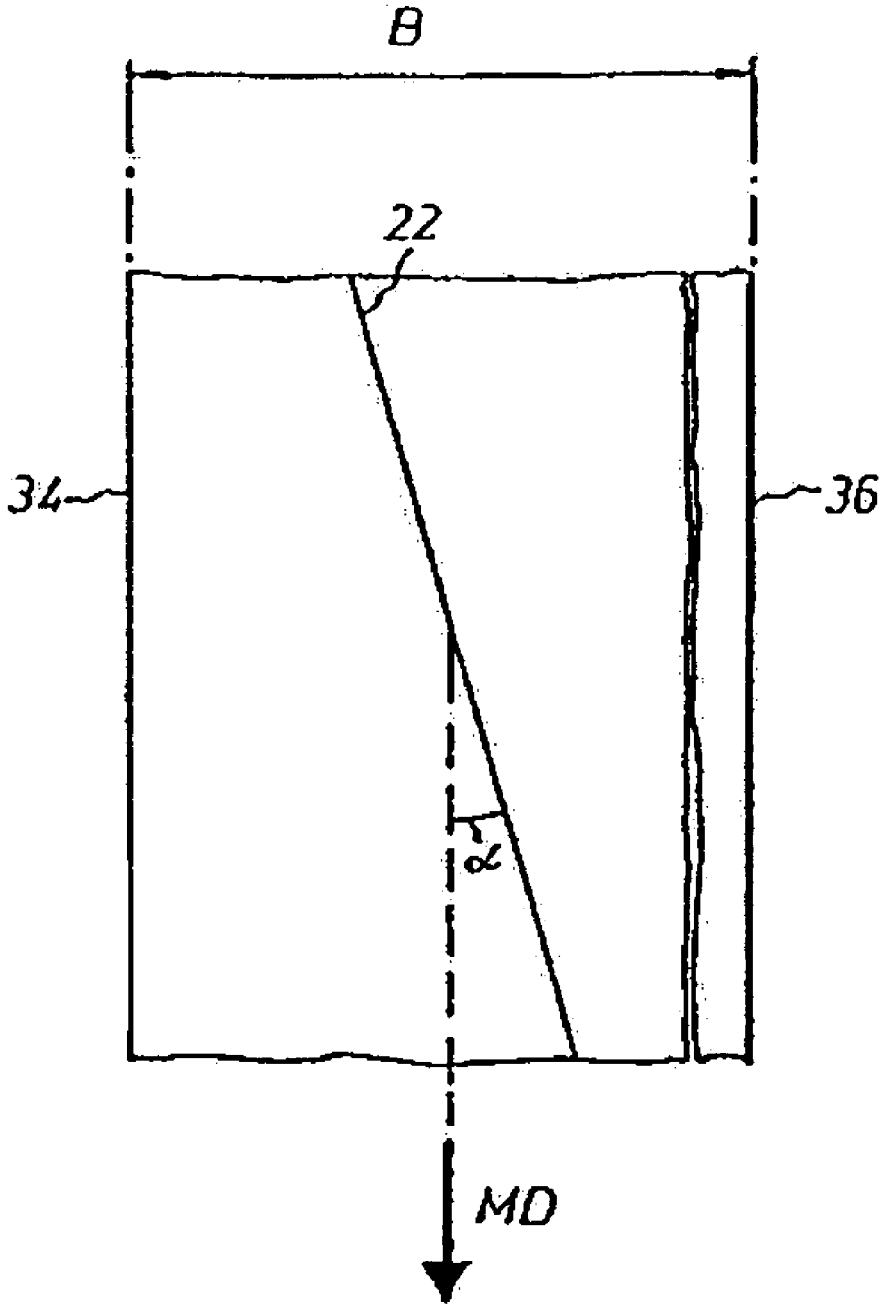
FIG. 2 (PRIOR ART)
FIG. 2 shows on an enlarged scale a broken-away part of a base fabric made according to FIG. 1 and schematically illustrating an angular relation between longitudinal threads in a base fabric.
Figure 3:
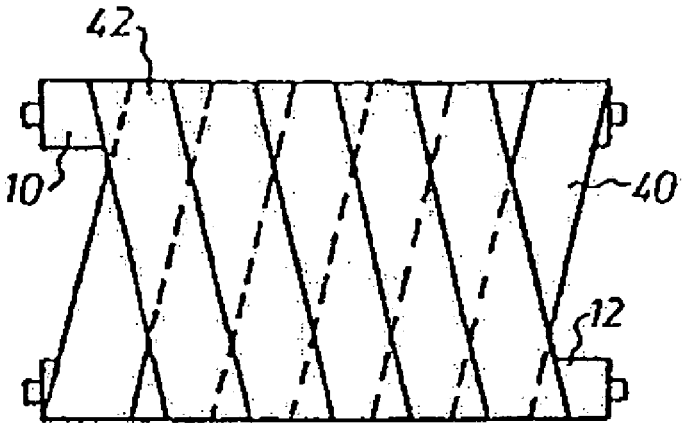
FIG. 3 (PRIOR ART)
FIG. 3 is a plan view of a spiral wound papermaker's fabric having two layers of spiral wound material.
Figure 4:
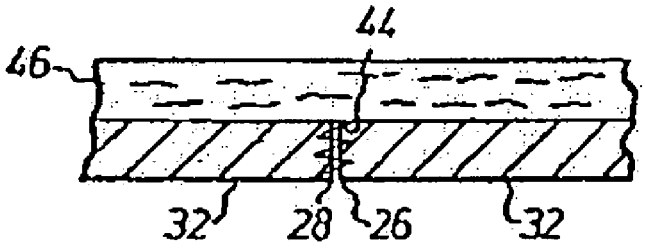
FIG. 4 (PRIOR ART)
FIG. 4 is a cross-sectional view of a butt seam of a spiral wound papermaker's fabric.
Figure 5:
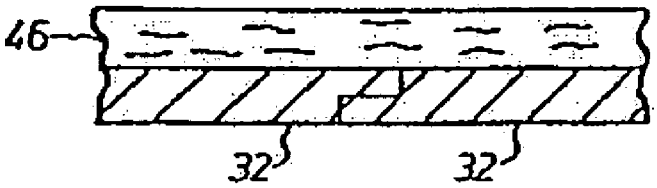
FIG. 5 (PRIOR ART)
FIG. 5 is a cross-sectional view of an overlapping seam of a spiral wound papermaker's fabric.
Figure 6A:
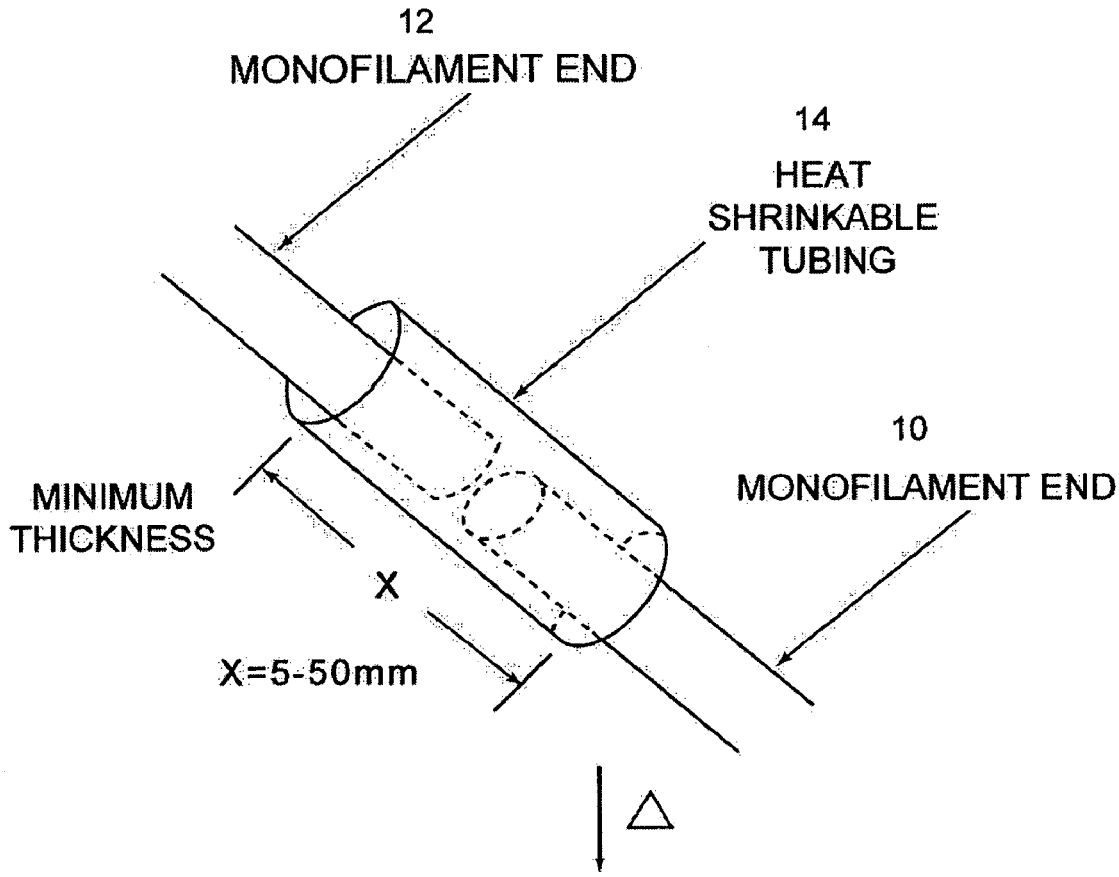
FIGS. 6*a* and *b* are perspective views of a butt joint according to one embodiment of the present invention.

FIG. 6*a* depicts a first embodiment of the present invention. In FIG. 6*a,* two monofilament yarns 10 and 12 are inserted into a heat shrinkable tubing 14 and butted together. As shown in FIG. 6*a,* the of heat shrinkable tubing 14 has sufficient length to give the overall desired strength in the final seam is placed over the two ends of monofilament yarns 10 and 12. Typically the heat shrinkable tubing 14 will have a length of approximately 5–50 mm depending upon the diameter of monofilament yarns 10, 12 and the application of the fabric.

The diameter of heat shrinkable tubing 14 is initially about 0.90 mm or less, however, this dimension is not critical, since the initial diameter is much more than the diameter of the yarns 10 and 12 it must shrink around. It is important to choose an initial heat shrinkable tubing diameter small enough such that the shrinkage that occurs is sufficient to ensure tight wrap of the two butted monofilament yarns 10 and 12 by the heat shrinkable tubing 14.

Figure 6B:
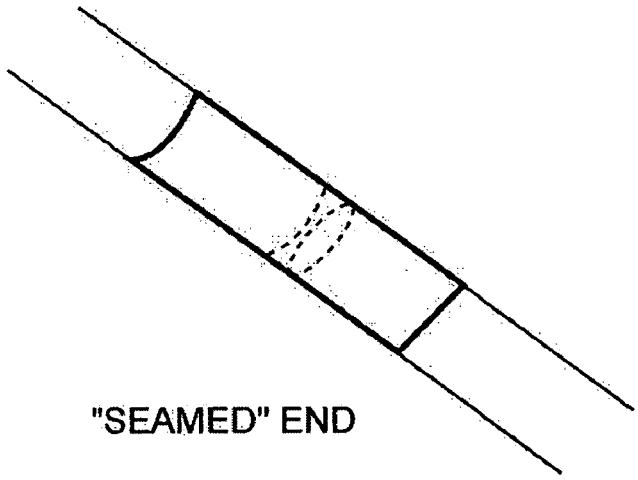

For a single monofilament butt joint, as shown in FIG. 6*a*, a single seamed end is obtained by applying heat to the heat shrinkable tubing 14. The heat required in commercial heat shrinkable materials is 175° C. or less. For this application, 175° C. represents an upper limit due to the heat setting conditions typically used to stabilize the fabric dimensions. After application of heat, the two butt joined yarn ends of the monofilament yarns 10 and 12 are securely held together by the tight wrap of the heat shrink tubing 14 as shown in FIG. 6*b*.

Figure 7A:
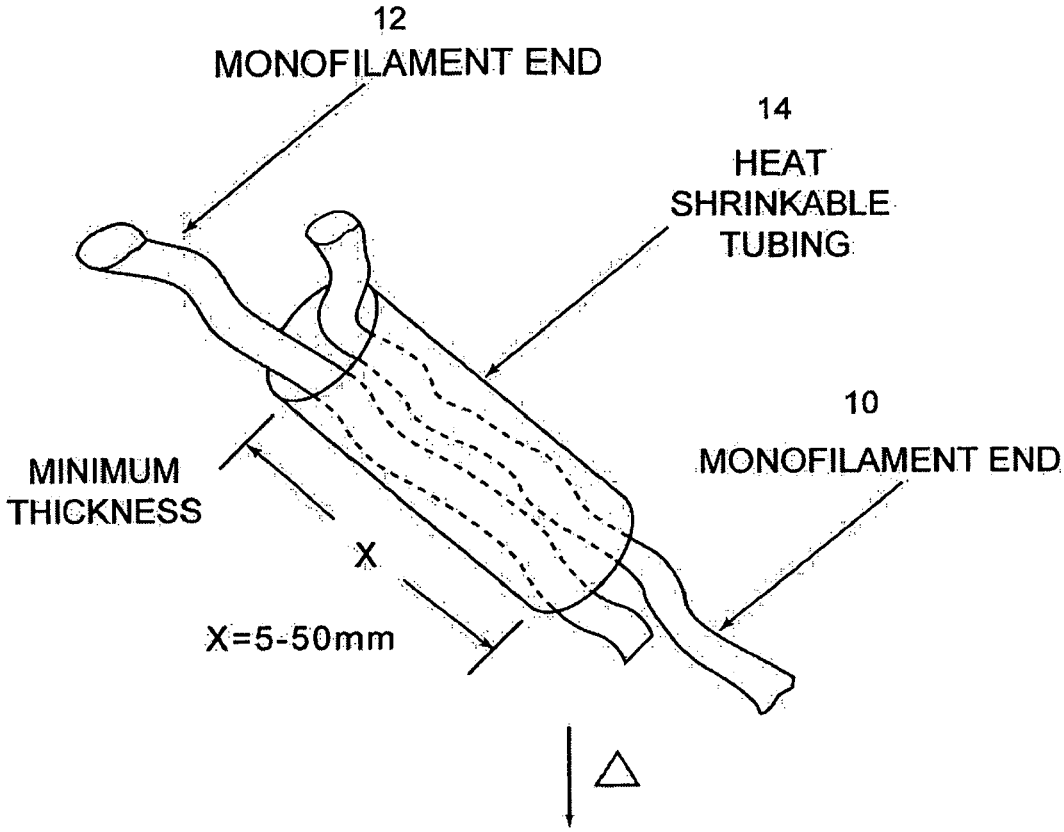
FIGS. 7*a* and *b* are perspective view of overlapping joints according to another aspect of the present invention.

FIG. 7 depicts another approach using heat shrinkable tubing. As shown in FIG. 7*a*, a sleeve of heat shrinkable tubing 14 of sufficient length to give the overall desired strength in the final seam is placed over the two ends of monofilament yarn 10 and 12 to be joined. These monofilament yarns 10 and 12 are overlapped up to a length greater than the length of the heat shrinkable tubing 14 resulting in the ends of the monofilament yarns 10, 12 protruding beyond the ends of the heat shrinkable tubing 14.

Figure 7B:
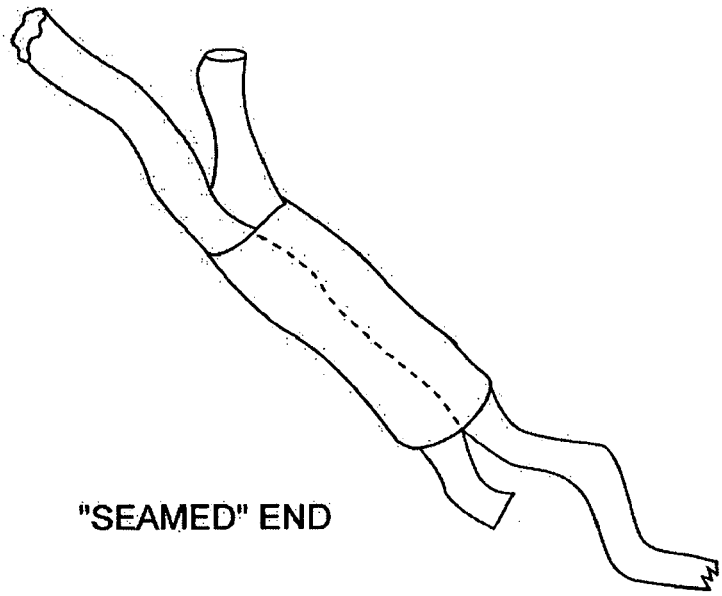

The diameter of the heat shrinkable tubing 14 is initially about 0.90 mm or less, however, this dimension is not critical, since the initial diameter is much more than the diameter of the monofilament yarns 10 and 12 it must shrink around. It is important to choose an initial diameter small enough such that the shrinkage that occurs is sufficient to ensure tight wrap of the two overlapped monofilament yarns 10 and 12 by the heat shrinkable tubing 14. This overlapping joint clamps the yarns together and gives the seam its tensile strength. Again, as shown in FIG. 7*b*, a single seamed end is obtained by applying heat to the heat shrinkable tubing 14. The heat required in commercial heat shrinkable materials is typically 175° C. or less. For this application, 175° C. represents an upper limit due to the heat setting conditions typically used to stabilize the fabric dimensions.

After application of heat, the two overlapped monofilament yarns 10 and 12 are securely held together in the overlapping joint by the tight wrap of the heat shrinkable tubing 14 as shown in FIG. 7*b*. The portions of the monofilament yarns 10 and 12 which protrude from the ends of the heat shrinkable tubing 14 can then be trimmed if necessary.

Figure 8:
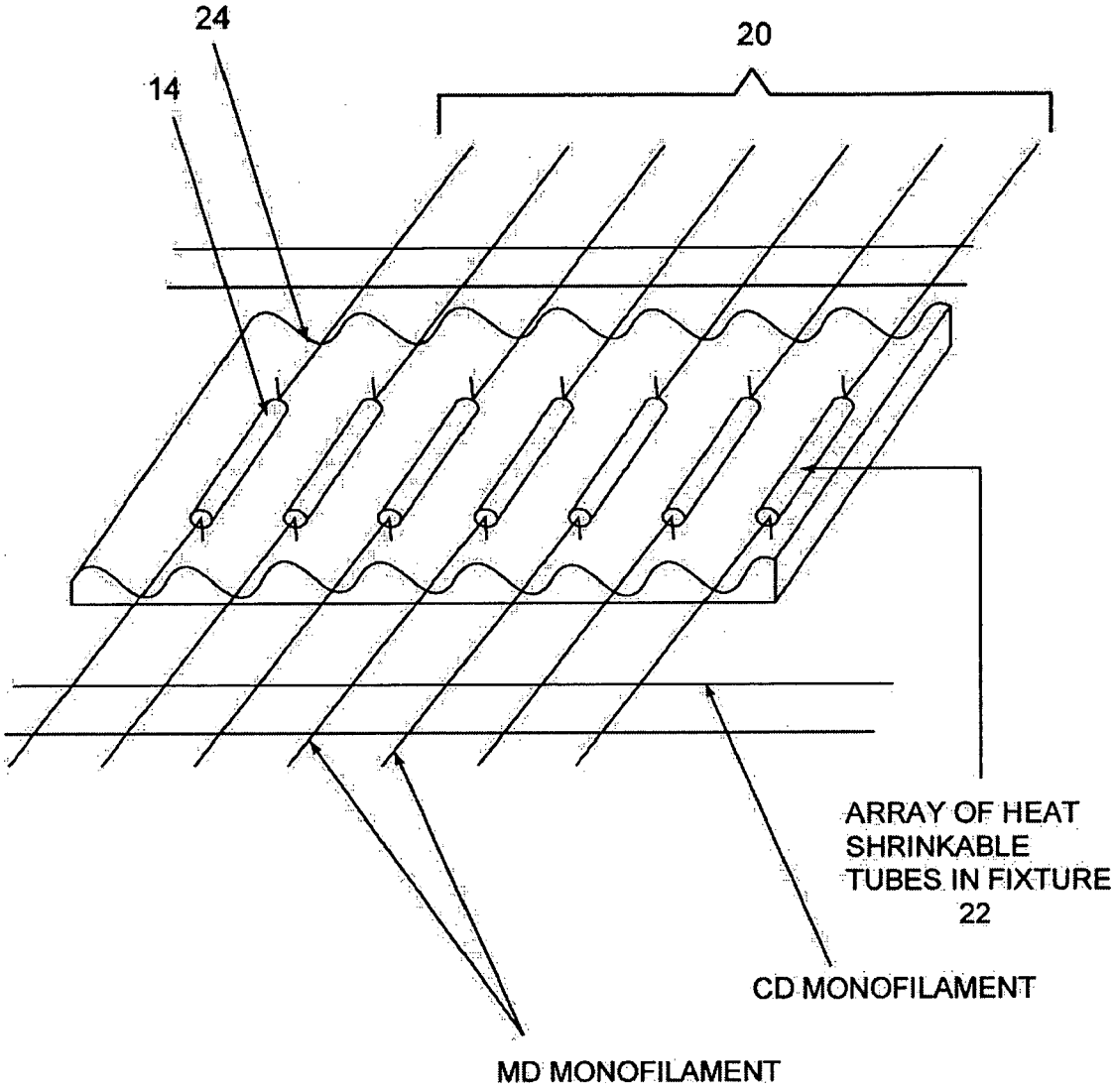
FIG. 8 is a perspective view of an array of butt-jointed threads and heat shrink tubes in a fixture according to the present invention.
Figure 9:
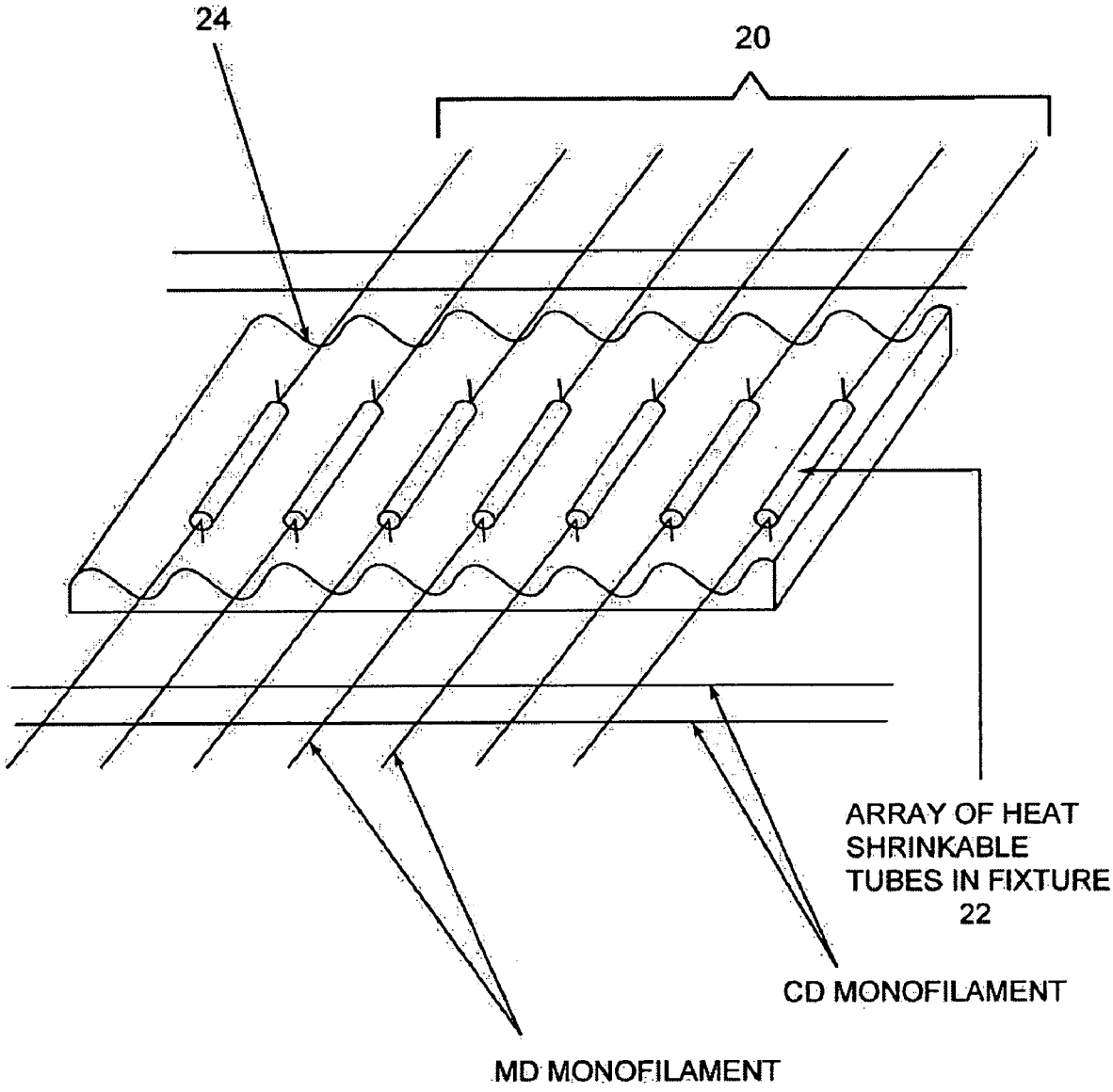
FIG. 9 is a perspective view of an array of overlapping joints and heat shrink tubes in a fixture according to the present invention

FIGS. 8 and 9 show an array of heat shrinkable tubes 14 held in position by a fixture 22. The fixture 22 holds the heat shrinkable tubes at approximately the spacing of the yarns 20 to be joined. The yarns 20 can be either MD or CD yarns. The fixture 22 may be formed with a plurality of grooves 24 for holding each heat shrinkable tubing section 14. Once the yarns are inserted into the heat shrinkable tubes 14 heat may be applied and the yarns are then securely held by the joint formed of the tight wrap of the heat shrinkable tubing.

In practice the entire length of the seam may be prepared in the fixture 24 with the yarns inserted into the heat shrinkable tubing 14 prior to the final heating to shrink the tubing and form the final seam. Accordingly, the fixture may have at least one groove 24 for each pair of yarns 10, 12 to be joined.

Further, the yarn ends can be crimped or not crimped, butted, overlapped with or without crimp, and overlapped with twisting with or without twisting. Each of these approaches has effects on final seam strength, permeability, and fabric aesthetics and would be chosen for the intended use of the fabric.

In one embodiment of the present invention, the yarns 10 and 12 may be cross machine directional (CD) yarns of a fabric strip formed by the method outlined in U.S. Pat. No. 5,360,656. The CD yarns for two fabric strips which are to be joined can be inserted into the heat shrink tubing 14 in either a butt or overlapped joint. Upon the application of heat the two strips will be effectively joined to one another forming a substantially machine directional (MD) seam. In applications where it is desirous to have the heat shrunk joint approximate the characteristics of yarns, the heat shrink tubing 14 may be formed of a porous material so that it acts consistently with the permeability and fluid flow characteristics of the fabric.

Because the fabric strips may be further processed with needled batt, and/or additional fabric layers laminated to form a composite fabric, in some circumstances it will not be necessary to join each CD yarn to another CD yarn in an adjacent strip. Rather, only sufficient CD yarns need be joined by this process to support the fabric for further processing.

Further, to optimize such a process, following the manufacture of the fabric strips that will ultimately be joined, the CD yarns preferably extend past the woven portion of the strip as a short fringe. Due to the properties of the yarns, this short fringe will enable the yarns to extend horizontally from the side of the fabric strip and enable easy insertion into a heat shrink tubing.

Another aspect of such an embodiment is that due to the limited nature of the seam, the heat shrink tubing itself may be formed of a soluble material which can break down either over time or in a subsequent step in the manufacturing process. The heat shrink tubing may be water or chemically soluble, or removed from the fabric through other means known to those of skill in the art. This heat shrink tubing and the seam that it forms may not be necessary in papermaker's fabrics which will include subsequent needling, laminating, or bonding to further fabrics. In these applications, the seam formed by the heat shrink tubing is merely to provide a sufficiently stable base fabric for later processing. It is this later processing which will ultimately bond the fabric strips and subsequent layers together.

In a further embodiment, a flat woven fabric can be made endless through the use of the heat shrink tubing 14. In such an embodiment, the MD yarns of the fabric can be joined to one another to form a CD seam. Such an application eliminates the need for weaving the ends of the MD yarns back into the fabric or the necessity of other known seaming techniques. In such an application, either every MD yarn could be joined using the heat shrink tubing, or alternatively, where the now endless fabric is to be joined to another fabric and subjected to further processing, only so many of the MD yarns as necessary to perform the subsequent processing steps need be joined. Again, in certain applications it may be desirable to use soluble tubing, or other temporary measures. Also, the tubing is preferably porous so that the seam has the required fluid flow properties similar to that of the fabric body.

In yet a further application two or more CD yarns could be bundled together. Each of these bundles of yarns could then be coupled to a corresponding bundle of yarns through the use of the heat shrink tubing, as discussed above. In such an embodiment it its understood that the heat shrinking tubing used to join the bundles of yarns would be of the appropriate size to allow for either butt joints or overlapping joints as desired by the practitioner.

Thus by the present invention its objects and advantages are realized, and although preferred embodiments have been disclosed and described in detail herein, its scope and objects should not be limited thereby; rather its scope should be determined by that of the appended claims.

We claim:

1. An endless papermaker's fabric for installation in a papermaking machine comprising: a plurality fabric strips formed of MD and CD yarns; and a plurality of heat shrunk joints connecting at least a percentage of said CD yarns to form a continuous loop of fabric, wherein said heat shrunk joints form an MD seam in said endless papermaker's fabric.

2. The endless papermaker's fabric of claim 1, wherein said heat shrunk joints are formed with a soluble heat shrink material.

3. The endless papermaker's fabric of claim 1 comprising a layer of needled batt.

4. The endless papermaker's fabric of claim 1, joined to another layer of fabric.

5. The endless papermaker's fabric of claim 4, wherein the layers of fabric are laminated.

6. The endless papermaker's fabric of claim 1, wherein the joint formed between the corresponding yarns is a butt joint.

7. The endless papermaker's fabric of claim 1, wherein the joint formed between the corresponding yarns is an overlapping joint.

8. The endless papermaker's fabric of claim 1, wherein the heat shrunk joints connect bundles of two or more yarns.

9. A papermaker's fabric for installation in a papermaking machine comprising: a plurality of CD yarns; a plurality of MD yarns; and a plurality of heat shrunk joints connecting adjacent ends of the MD yarns to form a continuous loop of fabric.

10. The papermaker's fabric of claim 9, wherein the machine directional yarns are monofilament.

11. The papermaker's fabric of claim 9, wherein the joint formed between the corresponding yarns is a butt joint.

12. The papermaker's fabric of claim 11, wherein the yarns of the butt joint are crimped.

13. The papermaker's fabric of claim 9, wherein the joint formed between the corresponding yarns is an overlapping joint.

14. The papermaker's fabric of claim 13, wherein the yarns in said overlapping heat shrucnk joints are twisted.

15. The papermaker's fabric of claim 13, wherein the yarns of the heat shrunk overlapping joints are crimped.

16. The papermaker's fabric of claim 9, wherein the plurality of heat shrunk joints connect bundles of two or more yarns.

17. An apparatus for forming a papermaker's fabric comprising: a grooved fixture for supporting a plurality of heat shrink tubing sections and enabling the insertion of yarns of said papermaker's fabric; and a heating means for applying heat to the heat shrink tubing, wherein upon application of the heat the heat shrink tubing reduces its size to form a tight joint between two yarns inserted in each of the heat shrink tubing sections.

18. A method of seaming of a papermaker's fabric comprising the steps of: providing a fixture for securing a plurality of heat shrink tubing sections; inserting at least two corresponding yarns of the papermaker's fabric into each of the heat shrink tubing sections; and applying heat to the heat shrink tubing wherein upon application of the heat the heat shrink tubing reduces its size to form a tight joint between two yarns inserted therein.

19. The method of claim 18, wherein the joint formed between the corresponding yarns is a butt joint.

20. The method of claim 19, wherein the yarns of the butt joint are crimped.

21. The method of claim 18, wherein the joint formed between the corresponding yarns is an overlapping joint.

22. The method of claim 21, wherein the yarns in said overlapping heat shrunk joints are twisted.

23. The method of claim 21, wherein the yarns of the overlapping joint are crimped.

24. The method of claim 18, wherein the corresponding yarns are MD yarns.

25. The method of claim 18, wherein the corresponding yarns are CD yarns.

26. The method of claim 18, wherein the at least two corresponding yarns each comprise bundles of at least two yarns.

* * * * *